US011655564B2

(12) United States Patent
Kim et al.

(10) Patent No.: US 11,655,564 B2
(45) Date of Patent: May 23, 2023

(54) GRAPHENE-BASED FIBER AND GRAPHENE-BASED CARBON FIBER AND METHOD OF MANUFACTURING THE SAME

(71) Applicant: Korea Advanced Institute of Science and Technology, Daejeon (KR)

(72) Inventors: Sang Ouk Kim, Daejeon (KR); Taeyeong Yun, Daejeon (KR); In Ho Kim, Daejeon (KR); Hong Ju Jung, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 746 days.

(21) Appl. No.: 16/506,062

(22) Filed: Jul. 9, 2019

(65) Prior Publication Data

US 2020/0017997 A1 Jan. 16, 2020

(30) Foreign Application Priority Data

Jul. 10, 2018 (KR) ..... 10-2018-0079802

(51) Int. Cl.
*D01F 9/145* (2006.01)
*D01G 13/00* (2006.01)

(52) U.S. Cl.
CPC ..... *D01F 9/145* (2013.01); *D01G 13/00* (2013.01); *D10B 2101/12* (2013.01); *D10B 2401/16* (2013.01)

(58) Field of Classification Search
CPC ... D01F 9/145; D01F 1/10; D01F 9/00; D01F 1/09; D01F 9/12; D01G 13/00; D10B 2101/12; D10B 2401/16; D01D 5/003; D01D 1/065; D01D 5/08; C01B 32/182; C01B 32/184; C01B 32/186; C01B 32/188; C01B 32/19; C01B 32/192; C01B 32/194; C01B 32/196; C01B 32/198; C01B 2204/00; C01B 2204/02; C01B 2204/04; C01B 2204/06; C01B 2204/065; C01B 2204/20; C01B 2204/22; C01B 2204/24; C01B 2204/26; C01B 2204/28;
(Continued)

(56) References Cited

U.S. PATENT DOCUMENTS 8,519,045 B2 8/2013 Jang et al.
10,458,046 B2 10/2019 Kim et al.
2010/0317790 A1* 12/2010 Jang ..... C01B 32/23 524/496

FOREIGN PATENT DOCUMENTS

KR 1020100099586 A 9/2010
KR 1020120105179 A 9/2012
(Continued)

OTHER PUBLICATIONS

Mochida, et al., Mesoscopic Sturcture and Properties of Liquid Crystalline Mesophase Pitch and Its Transformation into Carbon Fiber, The Chemical Record 2002; 2: 81-101 (Year: 2002).*
(Continued)

*Primary Examiner* — Daniel C. McCracken
(74) *Attorney, Agent, or Firm* — The Webb Law Firm

(57) ABSTRACT

Provided are a graphene-based fiber in which a liquid-crystalline aromatic compound is intercalated into a graphene-based material, a graphene-based carbon fiber obtained by carbonizing the graphene-based fiber, and a method of manufacturing the same.

8 Claims, 2 Drawing Sheets

(58) Field of Classification Search
CPC . C01B 2204/30; C01B 2204/32; C01B 32/20; C01B 32/205; C01B 32/21; C01B 32/215; C01B 32/22; C01B 32/225; C01B 32/23
See application file for complete search history.

(56) References Cited

FOREIGN PATENT DOCUMENTS

| | | | | | |
|---|---|---|---|---|---|
| KR | 1020150118432 | A | | 10/2015 | |
| KR | 1020180021360 | A | | 3/2018 | |
| KR | 10-2008-0082363 | | * | 7/2018 | ..... D01F 9/146 |
| KR | 10-2018-0082362 | | * | 7/2018 | ..... D01F 9/146 |
| KR | 101966104 | B1 | | 4/2019 | |

OTHER PUBLICATIONS

Machine Translation of KR 10-2008-0082363 to Yang et al. (Year: 2018).*

* cited by examiner

GRAPHENE-BASED FIBER AND GRAPHENE-BASED CARBON FIBER AND METHOD OF MANUFACTURING THE SAME

CROSS-REFERENCE TO RELATED APPLICATION

This application claims priority to Korean Patent Application No. 10-2018-0079802 filed Jul. 10, 2018, the disclosure of which is hereby incorporated by reference in its entirety.

TECHNICAL FIELD

The following disclosure relates to a graphene-based fiber, a graphene-based carbon fiber, and a method of manufacturing the same. More particularly, the following disclosure relates to a graphene-based fiber obtained by spinning a blend mixture in which a liquid-crystalline aromatic compound is intercalated into a graphene-based material via a π-π stacking bond, a graphene-based carbon fiber obtained by carbonizing the graphene-based fiber, and a method of manufacturing the same.

BACKGROUND

In general, an electrically conductive fiber refers to a fibrous material that can contain a material that can conduct electricity to the fiber itself or internal/external structures thereof, making it possible to allow a certain level of electricity to flow therein.

Methods of manufacturing such an electrically conductive fiber may be mainly classified into methods of using conductive polymers and methods of combining conductive materials.

Although the fibers manufactured so far by the former technology exhibit good electrical conductivity on a level greater than or equal to a semiconductor level, the fibers have severely degraded flexibility, which makes them difficult to use for textile product applications. Also, the fibers made of conductive polymers have insufficient conductivity to be used for sensor applications or electrical leads.

In the latter case, these methods may be more specifically divided into a method of incorporating a conductive additive material into fibers to manufacture the fibers, and a method of coating generic fibers with a conductive additive material using a plating technique. The conductive fibers manufactured by incorporating the conductive additive material into the fibers have excellent durability, and may realize various levels of physical properties and conductivity, depending on the conductive additive material and the fiber polymer to be used. However, the conductive fibers have drawbacks in that it is difficult to achieve a conductivity of $10^2$ S/cm or more, which is equivalent to a level of conductivity of a conductor, and the physical properties such as strength, elongation, and the like are degraded due to increased amounts of additives. On the other hand, because there is no great technical difficulty in manufacturing the conductive fibers by means of post-treatment coating, this has been variously attempted to produce the conductive fibers. However, it has problems in that decreased fiber texture and durability may be caused due to the coating.

Also, a method of manufacturing conductive fibers including graphene oxide as the conductive additive material commonly has a technical limitation so far in exhibiting a level of conductivity of $10^0$ S/cm (single digit), which is equivalent to those of semiconductors. To express a level of conductivity higher than those of semiconductors, it is very difficult to increase a content of the conductive additive material due to a decrease in dispersibility due to the high melt viscosity, an inevitable change in characteristics of the additive material due to the high temperature and shear force. Also, aggregation is caused and gelation occurs during fiber spinning when the graphene oxide is dispersed in a conductive solvent and added at a content of up to 1% by weight. Also, when the graphene oxide is prepared into electrically conductive fibers, a low concentration of the graphene oxide results in degraded process efficiency, and makes it impossible to realize the intrinsic physical properties of the electrically conductive fibers, thereby delaying its commercialization. In addition, because the graphene oxide is not melted at a high temperature, it is difficult to perform a simple melt-spinning process.

Accordingly, to utilize graphene-based materials such as graphene oxide and the like as the conductive fibers, there is a need for various studies to improve the dispersibility and compatibility of the graphene-based materials such as graphene oxide and the like, which are able to be spun at a high concentration and be melt-spun.

SUMMARY

An embodiment of the present invention is directed to providing a graphene-based fiber capable of spinning a high concentration of a blend mixture in which a liquid-crystalline aromatic compound is intercalated into a graphene-based material via a π-π stacking bond, and a method of manufacturing the same.

Another embodiment of the present invention is directed to providing a graphene-based fiber capable of spinning a blend mixture of the liquid-crystalline aromatic compound and the graphene-based material to improve a degree of crystallization and a degree of crystal orientation in a direction of the fiber axis, and a method of manufacturing the same.

Still another embodiment of the present invention is directed to providing a graphene-based carbon fiber having remarkably improved thermal conductivity and electrical conductivity, and a method of manufacturing the same.

Yet another embodiment of the present invention is directed to providing a method of manufacturing a graphene-based fiber or a graphene-based carbon fiber, which is capable of melt-spinning a graphene-based material and improving a spinning speed, a yield, and crystallinity when the graphene-based material is prepared into fibers.

In one general aspect, a method of manufacturing a graphene-based fiber according to the present invention includes: a) mixing a first composition including a liquid-crystalline aromatic compound and a second composition including a graphene-based material to prepare a blend mixture; and b) spinning the blend mixture to obtain a graphene-based fiber.

The blend mixture according to one aspect of the present invention may be melt-spun to obtain the fiber.

The blend mixture according to one aspect of the present invention may include the graphene-based material and the liquid-crystalline aromatic compound at a weight ratio of 1:0.25 to 1:100.

The blend mixture according to one aspect of the present invention may include 0.01 to 80% by weight of the graphene-based material, based on the total weight of the solid content of the blend mixture.

The liquid-crystalline aromatic compound according to one aspect of the present invention may be a polycyclic aromatic compound having an average molecular weight of 100 to 2,000 Da.

The liquid-crystalline aromatic compound according to one aspect of the present invention may be any one or a mixture of two or more selected from fluidized catalytic cracking-decant oil (FCC-DO), coal tar, and mesophase pitch.

The method of manufacturing a graphene-based carbon fiber according to the present invention includes carbonizing the graphene-based fiber manufactured by the aforementioned manufacturing method.

The carbonization according to one aspect of the present invention may be performed at 800 to 3,000° C. under an inert gas atmosphere.

The fiber according to the present invention is a fiber in which a liquid-crystalline aromatic compound is intercalated into a graphene-based material.

The fiber according to one aspect of the present invention may be in the form of layers in which the graphene-based material is oriented in a parallel direction with respect to the fiber axis, and the liquid-crystalline aromatic compound may be positioned between the layers so that the liquid-crystalline aromatic compound can be oriented in the parallel direction.

The liquid-crystalline aromatic compound and the graphene-based material according to one aspect of the present invention may be intercalated via a π-π stacking bond.

The graphene-based fiber according to one aspect of the present invention may be obtained by melt-spinning a blend mixture of the liquid-crystalline aromatic compound and the graphene-based material.

The graphene-based material and the liquid-crystalline aromatic compound according to one aspect of the present invention may be coupled at a weight ratio of 1:0.25 to 1:100.

The graphene-based carbon fiber according to the present invention is obtained by carbonizing the aforementioned graphene-based fiber.

DETAILED DESCRIPTION OF EMBODIMENTS

Figure 1:
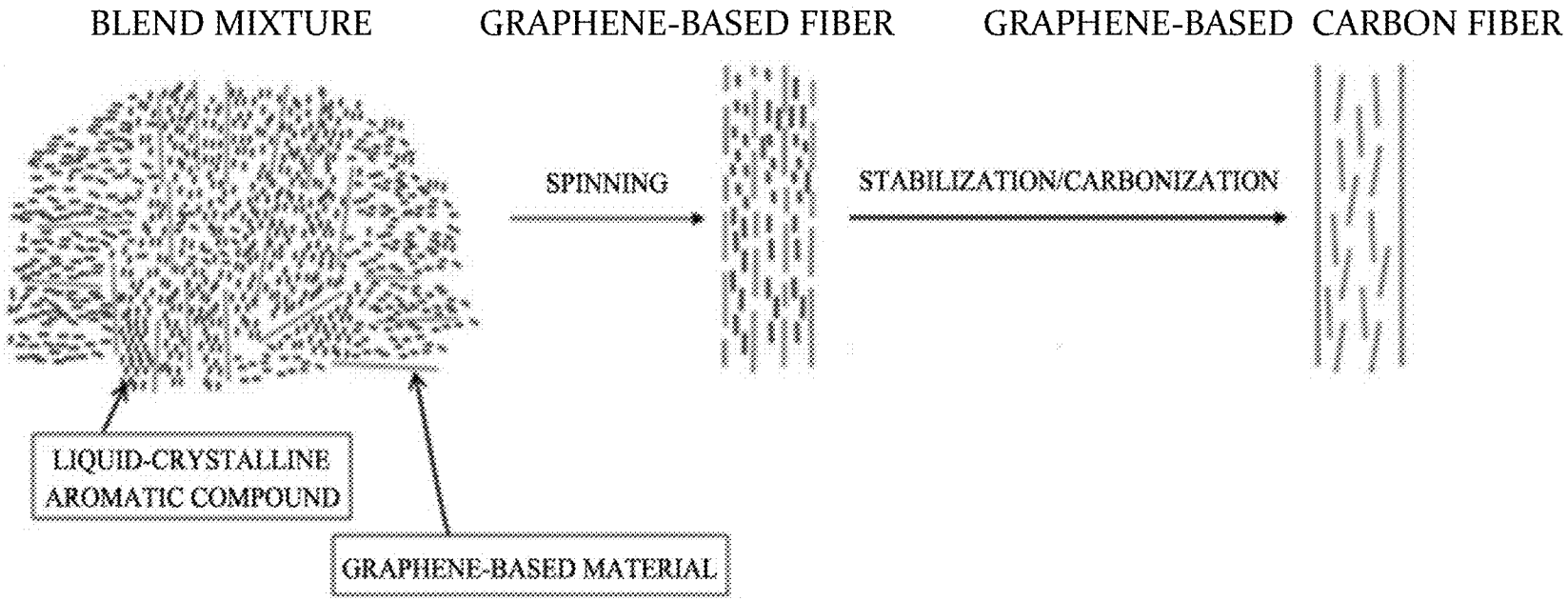
FIG. 1 is a schematic diagram of a method of manufacturing a graphene-based fiber and a graphene-based carbon fiber according to one embodiment of the present invention.

Hereinafter, a graphene-based fiber, a graphene-based carbon fiber, and a method of manufacturing the same according to the present invention will be described in further detail with reference to examples thereof. However, it should be understood that the following examples are illustrative only to describe the present invention in detail, but are not intended to limit the scope of the present invention, and thus may be embodied in various forms.

Unless otherwise defined, all the technical and scientific terms have the same meaning as commonly understood by one of ordinary skill in the art to which the present invention belongs. The terminology used herein for description is intended to effectively describe particular embodiments only and is not intended to be limiting of the present invention. The terms used herein for the detailed description are merely intended to effectively describe the certain examples of the present invention, but is not intended to limit the present invention.

In this specification, the term "intercalation" means that molecules, atoms, and ions are inserted between layers of a material having a layered structure, and, in the present invention, means that a liquid-crystalline aromatic compound is inserted between layers of a graphene-based material.

To achieve the above objects, the present invention relates to a graphene-based fiber, a graphene-based carbon fiber, and a method of manufacturing the same.

The present invention will be described in detail, as follows.

Based on the results of research addressed to achieve the above objects, a method of manufacturing a graphene-based fiber according to the present invention includes a) mixing a first composition including a liquid-crystalline aromatic compound and a second composition including a graphene-based material to prepare a blend mixture; and b) spinning the blend mixture to obtain a graphene-based fiber.

In the prior art, when the graphene-based material is dissolved in a solvent, gelation occurs when the graphene-based material is included in a content of up to 1% by weight or more, which makes it difficult to dissolve a high concentration of the graphene-based material in the solvent to form fibers during spinning. To solve the above problem, according to the present invention, the liquid-crystalline aromatic compound may be mixed with the graphene-based material so that the liquid-crystalline aromatic compound can be intercalated between the layers of the graphene-based material, and a high concentration of the graphene-based material may be dissolved or dispersed in the solvent to manufacture the fiber. Furthermore, a graphene-based material having no melting characteristics is provided with the melting characteristics to prepare a thermotropic blend mixture, which is then allowed to be melt-spun. Because the blend mixture includes a high concentration of the graphene-based material, it is possible to spin the blend mixture. Therefore, the blend mixture has no limitations to the gelation according to the solvent. Also, the graphene-based material may be formed at a high concentration and density to manufacture a graphene-based fiber having high crystallinity, which may be then carbonized to provide a graphene-based carbon fiber having superior electrical conductivity. Also, the graphene-based fiber and the graphene-based carbon fiber according to the present invention may have effects of not only recycling the liquid-crystalline aromatic compound discarded as a waste material but also simplifying a process through spinning, thereby lowering the cost of graphene-based carbon fiber raw materials and lowering the manufacturing cost of the process.

According to one aspect of the present invention, the graphene-based material may have a maximum diameter/thickness ratio of 30 or more, which is a ratio of the maximum diameter to the thickness. Preferably, the maximum diameter/thickness ratio of the graphene-based material may be in a range of 10,000 to 500,000, and more preferably in a range of 10,000 to 100,000, but the present invention is not limited thereto. When the graphene-based material having this maximum diameter/thickness ratio is used, the graphene-based material may be prepared with a critical concentration to exhibit liquid crystallinity, thereby exhibiting a liquid crystal phase. Because the graphene-based material has excellent miscibility with the liquid-crystalline aromatic compound, the liquid-crystalline aromatic compound may be uniformly intercalated between the layers of the graphene-based material.

According to one aspect of the present invention, the graphene-based material may be any one or a mixture of two or more selected from reduced graphene (RG), reduced graphene oxide (RGO), graphene, graphene oxide (GO), and the like. To achieve an objective of improving the dispersibility and compatibility, the graphene-based material may be preferably reduced graphene oxide (RGO) and graphene oxide (GO).

According to one aspect of the present invention, the graphene oxide may be used as the same meaning as graphene oxide, oxidized graphene, and the like. Further, such reduced graphene oxide and graphene oxide are not limited as long as the reduced graphene oxide and the graphene oxide are manufactured by means of a method of manufacturing the graphene oxide, as commonly used in the art. Specifically, the reduced graphene oxide and the graphene oxide may be manufactured by means of a method of oxidizing a carbon material such as graphite, and the like. More specifically, reduced graphene oxide and graphene oxide, which are manufactured by means of a method of oxidizing graphite using an oxidation method such as a Hummer's method, a Brodie's method, or a Staudenmaier method, may be used.

According to one aspect of the present invention, the graphene-based material may be oxidized so that the graphene-based material can have a carbon:oxygen atomic ratio of 1:0.03 to 1:1, preferably 1:0.03 to 1:0.6, and more preferably 1:0.05 to 1:0.6. As described above, when a blend mixture including the graphene-based material having this carbon:oxygen atomic ratio is prepared, the blend mixture may be maintained at a low viscosity, and thus may prevent gelation, and may contain a higher content of the graphene-based material.

According to one aspect of the present invention, a second composition including the graphene-based material may be prepared so that the second composition can include the graphene-based material and a solvent. The solvent may serve to disperse the graphene-based material, and may be, for example, selected from the group consisting of an ester-based solvent, an alcohol-based solvent, an aromatic solvent, an alicyclic solvent, a heteroaromatic solvent, a heteroalicyclic solvent, an alkane-based solvent, a ketone-based solvent, a halogenated solvent, and the like. Specifically, the solvent may be any one or a mixed solvent of two or more selected from chloroform, acetone, ethanol, methanol, benzene, toluene, cyclohexane, normal hexane (n-hexane), pyridine, quinoline, ethylene glycol, dimethyl formamide, dimethyl acetamide, N-methyl pyrrolidone, tetrahydrofuran, and the like, but the present invention is not limited thereto.

According to one aspect of the present invention, the second composition may include 0.01 to 80% by weight, preferably 0.8 to 70% by weight, and more preferably 1 to 50% by weight, of the graphene-based material, based on the total weight of the second composition. When the first composition is prepared within this content range, the second composition may be prepared into a thermotropic liquid crystal phase while being uniformly miscible with the liquid-crystalline aromatic compound, thereby imparting liquid crystallinity.

According to one aspect of the present invention, the liquid-crystalline aromatic compound may include mesophase pitch prepared by heat-treating a coal-based or petroleum-based residuum. When a liquid crystal phase is formed while intercalating the mesophase pitch into the layers of the graphene-based material, the mesophase pitch may form a meltable thermotropic liquid crystal phase. Also, when a graphene-based fiber including the meltable thermotropic liquid crystal phase is carbonized, the graphene-based fiber may exhibit excellent thermal and electrical conduction characteristics, and may also have superior mechanical properties.

Preferably, according to one aspect of the present invention, the liquid-crystalline aromatic compound may be a polycyclic aromatic compound having an average molecular weight of 100 to 2,000 Da, and preferably 100 to 1,000 Da, as determined using MALDI-TOF. When the liquid-crystalline aromatic compound according to the present invention has this molecular weight as described above, the liquid-crystalline aromatic compound may impart the melting characteristics to the graphene-based material, and may control a melting temperature of the blend mixture. Also, because the liquid-crystalline aromatic compound has a polycyclic aromatic structure, the liquid-crystalline aromatic compound may impart fluidity to the blend mixture at a melting point or higher.

The liquid-crystalline aromatic compound may have a polycyclic aromatic structure containing three or more aromatic rings. Specifically, the polycyclic aromatic structure may be a polycyclic aromatic structure containing 3 to 10 aromatic rings, but the present invention is not limited thereto.

According to one aspect of the present invention, the liquid-crystalline aromatic compound is a polycyclic aromatic compound having an average molecular weight of 100 to 2,000 Da, as determined using MALDI-TOF. Specific examples of the liquid-crystalline aromatic compound may be any one or a mixture of two or more selected from fluidized catalytic cracking-decant oil (FCC-DO), which is the petroleum-based liquid-crystalline aromatic compound, coal tar, which is the coal-based liquid-crystalline aromatic compound, and the like, but the present invention is not limited thereto. When a liquid crystal phase is formed while intercalating the liquid-crystalline aromatic compound between the layers of the graphene-based material via a $\pi$-$\pi$ stacking bond using the van der Waals interaction, the liquid-crystalline aromatic compound may form a meltable thermotropic liquid crystal phase. In the present invention, a degree of orientation of the liquid-crystalline aromatic compound is not limited, but the degree of orientation may be in a range of 0.6 to 0.9. In the case of the liquid-crystalline aromatic compound having this degree of orientation as described above, the graphene-based material may be included at a high concentration, and spun, and the yield and crystallinity may be improved due to an increase in spinning speed. Also, when the graphene-based fiber including the liquid-crystalline aromatic compound is thermally treated by carbonization, the graphene-based fiber may have a high carbonization yield due to the excellent stability, and may exhibit excellent thermal and electrical conduction characteristics after carbonization due to the high crystallinity.

According to one aspect of the present invention, the FCC-DO refers to a by-product that remains after producing LPG, gasoline, diesel, and the like through a fluid catalytic cracking process using a vacuum gas oil generated in a refining process.

According to one aspect of the present invention, the coal tar is a dark brown or black liquid-phase material that is produced as a by-product when coal is dried by distillation at 900 to 1,200° C., and has a high viscosity. In this case, the blend mixture may have various compositions, and may include any one or two or more selected from the FCC-DO and the coal tar.

Also, to uniformly blend the liquid-crystalline aromatic compound and the graphene-based material according to the present invention to form a liquid crystal phase, a degree of oxidation of the graphene-based material, a ratio of the graphene-based material and the liquid-crystalline aromatic compound, and a molecular weight of the liquid-crystalline aromatic compound should be optimized.

A fiber having high crystallinity and liquid crystallinity, and a graphene-based carbon fiber having high thermal conductivity and electrical conductivity may be manufactured directly using the aforementioned liquid-crystalline aromatic compound as a raw material without any process of extracting a solvent and removing a catalyst.

According to one aspect of the present invention, a first composition including the liquid-crystalline aromatic compound may be prepared so that the first composition can include the liquid-crystalline aromatic compound and a solvent. The solvent may serve to dissolve or disperse the liquid-crystalline aromatic compound, and may, for example, be selected from the group consisting of an ester-based solvent, an alcohol-based solvent, an aromatic solvent, an alicyclic solvent, a heteroaromatic solvent, a heteroalicyclic solvent, an alkane-based solvent, a ketone-based solvent, a halogenated solvent, and the like. Specifically, the solvent may be selected from chloroform, acetone, ethanol, methanol, benzene, toluene, cyclohexane, n-hexane, pyridine, quinoline, ethylene glycol, dimethyl formamide, dimethyl acetamide, N-methyl pyrrolidone, tetrahydrofuran, and the like, but the present invention is not limited thereto. The same solvent may be used in the first composition and the second composition. In this case, when different solvents are used, the solvents may be mixed and used due to the excellent compatibility between the two solvents.

Also, when a high density of the graphene-based material is included, a graphene-based fiber having improved degrees of orientation and crystallization may be manufactured. Then, the graphene-based fiber may be carbonized to manufacture a graphene-based carbon fiber capable of exhibiting higher electrical conductivity and mechanical strength.

According to one aspect of the present invention, the first composition may include 0.01 to 80% by weight, preferably 0.8 to 70% by weight, and more preferably 1 to 50% by weight, of the liquid-crystalline aromatic compound, based on the total weight of the first composition. When the first composition is prepared in this content range, the liquid-crystalline aromatic compound may be sufficiently intercalated between the layers of the graphene-based material, thereby imparting the melting characteristics to the graphene-based material while being mixed with the second composition, and controlling a melting temperature of the blend mixture.

According to one aspect of the present invention, to uniformly disperse the first composition and the second composition, the first composition and the second composition may be uniformly and stably dispersed using an ultrasonication method, a mechanical stirring method, a mixed method thereof, and the like, but the present invention is not limited thereto. Also, according to one aspect, to remove impurities included in the blend mixture in which the first composition and the second composition are mixed, the impurities may be removed using dialysis or centrifugation, but the present invention is not limited thereto.

The blend mixture according to the present invention may include the graphene-based material and the liquid-crystalline aromatic compound at a weight ratio of 1:0.25 to 1:100, preferably a weight ratio of 1:0.5 to 1:50, and more preferably a weight ratio of 1:0.5 to 1:30. When the graphene-based material and the liquid-crystalline aromatic compound are combined as described above, the blend mixture may have improved fluidity and spinning properties during the spinning, and exhibit a liquid crystal phase.

According to one aspect of the present invention, after the solvent is removed, the blend mixture may include 0.01 to 80% by weight, preferably 10 to 70% by weight, and more preferably 30 to 60% by weight, of the graphene-based material, based on the total weight of the solid content of the blend mixture. When the graphene-based material is included as described above, the graphene-based material may be prepared into a thermotropic liquid crystal phase while being uniformly miscible with the liquid-crystalline aromatic compound, thereby imparting liquid crystallinity.

According to one aspect of the present invention, the blend mixture may be spun by means of melt-spinning, wet spinning, or electrospinning.

According to one aspect of the present invention, the wet spinning is a method in which a pressure is applied to a blend mixture to spin the blend mixture into a coagulating bath through a small spinneret so that the blend mixture is coagulated in the coagulating bath, and fibers are formed when the blend mixture starts to solidify and leach as a solvent is diffused into the coagulating bath. The wet spinning may be used even when a chemical reaction occurs in the blend mixture that is a spinning solution, and the liquid-crystalline aromatic compound is neither easily dissolved in a highly volatile solvent nor easily melted. The fiber thus manufactured may have sufficient mechanical properties to be wound on a roller.

According to one aspect of the present invention, a spinning temperature of the spinning solution may be in a range of 10 to 100° C., preferably 20 to 80° C., but the present invention is not limited thereto. Also, a pressure applied during the spinning of the spinning solution may be in a range of 1 to 50 psi, but the present invention is not limited thereto. A temperature of the coagulant solution may be in a range of −5 to 50° C., and preferably 0 to 40° C., in order to coagulate fibers to be spun, but the present invention is not limited thereto. Also, the coagulant solution is not particularly limited as long as the coagulant solution may be used to coagulate the spun fibers. For example, one or a mixture of two or more selected from water, an aqueous nitric acid solution, an aqueous hydrochloric acid solution, an aqueous calcium chloride ($CaCl_2$)) solution, N-methyl pyrrolidone, formamides, methanol, ethanol, propanol dimethyl sulfoxide, dimethyl formamide, and dimethyl acetamide, ethyl acetate, acetone, and the like may be used as the coagulant solution. Specifically, a non-solvent component which is not dissolved with respect to the liquid-crystalline aromatic compound in the spinning solution and is highly compatible with the solvent in the first composition and the second composition is preferably used. Therefore, the different types of the solvents and coagulant solutions in the first composition and the second composition may be preferably used.

According to one aspect of the present invention, the blend mixture may be obtained by dispersing and dissolving the graphene-based material and the liquid-crystalline aromatic compound in the solvent during the wet spinning. Upon the wet spinning, the blend mixture may include 1 to 30% by weight of the graphene-based material and the liquid-crystalline aromatic compound, and 70 to 99% by weight of the solvent, based on the total weight of the blend mixture. Preferably, the blend mixture may include 1 to 10% by weight of the graphene-based material and the liquid-crystalline aromatic compound, and 90 to 99% by weight of the solvent.

According to one aspect of the present invention, according to specific examples of the electrospinning, a solvent may be volatilized by a positive (+) voltage, and fibers may be manufactured in a fiber structure in which the liquid-crystalline aromatic compound is intercalated between layers of the graphene-based material. The electrospun fibers are collected using a collector having relatively negative (−) charges due to the electric field. Upon the electrospinning, the positive (+) voltage and the negative (−) voltage may be properly chosen depending on the liquid-crystalline aromatic compound and the solvent. Also, the thickness of the fibers may be controlled, and the quality of fibers to be manufactured, and the like may be determined by a voltage (kV/cm) applied per distance in the electrospinning, an amount (mL/min, mL/h, 1/h) of an injected solution, and an injection hole (i.e., a nozzle, a needle). Upon the electrospinning, the positive (+) applied voltage may be adjusted by the intrinsic characteristics of the liquid-crystalline aromatic compound as well as a distance between the collector and the injection hole. For example, the positive (+) applied voltage may be in a range of 6 to 50 kV, and more preferably 6 to 15 kV, the distance between the injection hole and the collector may be in a range of 8 to 30 cm, preferably 10 to 15 cm, and the collector may be a conductor such as aluminum foil, and the like, but the present invention is not limited thereto. In the case of the amount of the injected solution, a higher positive (+) applied voltage is required to inject the solution at a higher injection rate. Therefore, it is possible to adjust a production amount of fibers over time. Also, the injection hole generally includes injection holes having various diameters ranging from 0.1 to 1.4 mm, but the diameter of the injection hole for electrospinning may be determined depending on the liquid-crystalline aromatic compound, and the uniformity and thickness of the manufactured fibers may be determined depending on the choice of the injection hole.

According to one aspect of the present invention, the blend mixture may be a blend mixture in which the graphene-based material and the liquid-crystalline aromatic compound are dispersed or dissolved in the solvent during the electrospinning. Upon the electrospinning, the blend mixture may include 0.8 to 30% by weight of the graphene-based material and the liquid-crystalline aromatic compound, and 70 to 99.2% by weight of the solvent, based on the total weight of the blend mixture. Preferably, the blend mixture may include 1 to 10% by weight of the graphene-based material and the liquid-crystalline aromatic compound, and 90 to 99% by weight of the solvent.

When the wet spinning or electrospinning is performed as described above, the blend mixture includes a high concentration of the graphene-based material, and thus may be spun. Therefore, the blend mixture has no limitations to the gelation according to the solvent.

Preferably, according to one aspect of the present invention, the blend mixture may be melt-spun to obtain fibers.

According to one aspect of the present invention, a method of manufacturing the fibers through melt-spinning specifically includes a melting step of melting a blend mixture; and a spinning step of melt-spinning the melted blend mixture to obtain fibers.

According to one aspect of the present invention, the solvent in the first composition and the second composition may be removed in order to allow the blend mixture to go through the melting step. Preferably, the blend mixture may go through a predetermined drying process to completely remove the residual solvent.

The drying is not particularly limited, and the blend mixture may be dried using a drying system generally used in the art. As one specific example, the blend mixture may be centrifuged to separate layers from a blend mixture of the solvent with the graphene-based material and the liquid-crystalline aromatic compound, followed by the use of a vacuum pump. The temperature may be raised to facilitate the removal of the solvent, but the present invention is not limited thereto.

According to one aspect of the present invention, in the melt-spinning, the blend mixture may be formed by extruding the melt through a die spinneret. As the melt moves downwards through a zone with a controlled temperature, the melt is cooled to a melting temperature or less, and consequently comes into contact with a spinning roller. As the spinning roller, a filament take-up roll may accelerate molten filaments when the filaments are released through a die spinneret. Then, the filament take-up roll may further condition, elongate, and take up the fibers using one or more additional rollers and take-up rolls. The process may be used to manufacture yarns having different levels of orientation, depending on the velocity of the filament take-up roll. The process may be generally utilized to manufacture fibers having a very long and essentially continuous length. Also, melt-spinning devices spanning from laboratory-scaled monofilament-spinning devices to industrial-scaled multi-filament yarn-spinning devices may be applied without any limitation.

Specifically, because the blend mixture may be melt-spun while mixing the liquid-crystalline aromatic compound and the graphene-based material to impart the melting characteristics to the graphene-based material, the graphene-based material may be uniformly oriented through the melt-spinning to have liquid crystallinity.

According to one aspect of the present invention, the melting step may be performed by filling a cylinder of a spinning machine with the blend mixture, and warming the blend mixture to 250 to 380° C. to melt the blend mixture while maintaining the blend mixture for 30 minutes to 2 hours.

According to one aspect of the present invention, in a specific example of the spinning step, fibers may be manufactured using a spinning process of spinning the prepared blend mixture through a spinneret at a spinning temperature of 250 to 380° C., preferably 250 to 350° C., and at a take-up velocity of 10 to 800 m/min. The uniformity and thickness of fibers to be manufactured may be determined, and the excellent orientation and crystallinity of liquid crystal phases of the fibers may be expressed, depending on the choice of the injection hole.

Also, according to one aspect of the present invention, the blend mixture may have a spinning property of being taken up at a take-up velocity of 10 to 800 m/min during the melt-spinning. Owing to such a spinning property, the blend mixture may form a graphene-based fiber without easily breaking the fiber during the spinning. Therefore, the blend mixture is preferred as a precursor material for graphene-based carbon fibers having excellent electrical conductivity and thermal conductivity.

For the graphene-based fiber according to the present invention, the liquid-crystalline aromatic compound is intercalated into the graphene-based material. Also, the graphene-based fiber may be manufactured using the aforementioned manufacturing method. The graphene-based fiber may have liquid crystallinity.

According to one aspect of the present invention, the graphene-based fiber may be in the form of layers in which the graphene-based material is oriented in a parallel direction with respect to the fiber axis, and the liquid-crystalline aromatic compound may be positioned between the layers so that the liquid-crystalline aromatic compound can be oriented in the parallel direction. Because the graphene-based fiber may be in the form as described above, the graphene-based fiber may have high crystallinity, and also may have excellent mechanical strength as well as realize liquid crystallinity.

Specifically, the graphene-based fiber may be obtained by intercalating the liquid-crystalline aromatic compound into the graphene-based material via a π-π stacking bond. The π-π stacking bond means that polycyclic aromatic groups are evenly piled up and bonded to each other. As a specific example, the liquid-crystalline aromatic compound (e.g., a polycyclic aromatic compound) is bonded between the planes of the graphene-based materials via a strong interaction. In this case, although the strength is weak, a sufficient amount of n-n stacking bonds are formed. Therefore, the graphene-based fiber thus manufactured may express superior mechanical strength.

According to one aspect of the present invention, the graphene-based fiber may be obtained by melt-spinning a blend mixture including the liquid-crystalline aromatic compound and the graphene-based material. When a spinning solution in which a conventional graphene-based material is dissolved in a solvent includes up to 1% by weight of the graphene-based material, gelation may occur, and the fluidity of the spinning solution may be restricted due to the high viscosity. Therefore, because the graphene-based fiber including a low concentration of the graphene-based material is manufactured in the spinning solution, the spinning solution has limitations in improving the electrical conductivity. However, the graphene-based fiber according to the present invention may have excellent electrical conductivity and thermal conductivity because the graphene-based fiber includes a high concentration of the graphene-based material so that the graphene-based fiber can be formed at a high density. Furthermore, when the graphene-based fiber is carbonized, the graphene-based fiber may have superior electrical conductivity and thermal conductivity, and realize remarkably improved mechanical strength as well.

According to one aspect of the present invention, because the graphene-based material and the liquid-crystalline aromatic compound are oriented in the graphene-based fiber, the graphene-based fiber may also improve a degree of crystallization of the liquid-crystalline aromatic compound and a degree of crystal orientation in a direction of the fiber axis, and may have excellent thermal conductivity and electrical conductivity.

The blend mixture of the present invention may include the graphene-based material and the liquid-crystalline aromatic compound at a weight ratio of 1:0.25 to 1:100, preferably a weight ratio of 1:0.5 to 1:50, and more preferably a weight ratio of 1:0.5 to 1:30. When the graphene-based material and the liquid-crystalline aromatic compound are included and combined in these amounts as described above, the blend mixture may have improved fluidity and spinning properties and exhibit a liquid crystal phase during the spinning.

The graphene-based fiber according to the present invention may have an advantage of the graphene-based material and an advantage of liquid crystals at the same time. Therefore, the directionality of the graphene-based fiber may be adjusted using an external field such as a magnetic field, a flow field, or the like, which is one of the intrinsic characteristics of the liquid crystals, and the graphene-based carbon fiber may exhibit anisotropically optical, dielectric, mechanical properties, and the like in macroscopic aspects, thereby making it possible to enlarge the utilization of graphene-based materials and establish new processes.

A method of manufacturing a graphene-based carbon fiber according to another aspect of the present invention will be described in detail, as follows.

The method of manufacturing a graphene-based carbon fiber according to the present invention further includes carbonizing the graphene-based fiber manufactured by the aforementioned method of manufacturing a graphene-based fiber.

Specifically, the method of manufacturing a graphene-based carbon fiber according to the present invention may include a) mixing a first composition including a liquid-crystalline aromatic compound and a second composition including a graphene-based material to prepare a blend mixture, b) spinning the blend mixture to obtain a graphene-based fiber, and c) carbonizing the graphene-based fiber to obtain a graphene-based carbon fiber.

According to one aspect of the present invention, the carbonizing of the graphene-based fiber manufactured by the aforementioned method of manufacturing a graphene-based fiber includes carbonizing the graphene-based fiber to convert the graphene-based fiber into the graphene-based carbon fiber. The carbonization may be performed at 800 to 3,000° C. under an inert gas atmosphere. Preferably, the carbonization may be performed at 800 to 3,000° C. for 30 to 90 minutes while raising the temperature from room temperature to 800 to 3,000° C. at 5° C. per minute. Specifically, the carbonization temperature may be an external ambient temperature during a carbonization process, or may be an exothermic temperature of carbon fibers, but the present invention is not limited thereto. When the carbonization is performed as described above, the graphene-based carbon fiber, which has improved mechanical properties while maintaining a shape of the fiber, and has excellent electrical conductivity and thermal conductivity even when carbonized at a high density, may be manufactured.

According to one aspect of the present invention, the carbonization may be performed through primary to tertiary carbonization processes. Preferably, when the carbonization is performed through the secondary and tertiary carbonization processes, the carbonization may be performed at different temperatures for different periods of time. As a specific example, the physical properties of the carbon fibers may be controlled by performing a primary carbonization process at 800 to 1,500° C., a secondary carbonization process at 1,200 to 1,500° C., and a third graphitization process at 2,000 to 3,000° C., but the present invention is not limited thereto.

According to one aspect of the present invention, when the carbonization is performed under the aforementioned temperature condition, a carbonization method is not particularly limited. For example, the carbonization may be performed by applying an electric current to the fiber to generate Joule's heat. More specifically, after the primary carbonization is performed, a voltage may be applied to the primarily carbonized carbon fibers to generate the Joule's heat due to the electric current flowing in the carbon fibers, thereby graphitizing the carbon fibers. When the Joule's heat is generated to carbonize the carbon fibers as described above, hot heat may be suddenly generated in a short time to effectively realize the carbonization and graphitization of the carbon fibers. Also, when the Joule's heat is generated in a crystal direction of the graphene-based material in the carbon fibers, it is possible to expect an effect of aligning the liquid-crystalline aromatic compound along the lattice of the graphene-based material.

According to one aspect of the present invention, the power density of the electric current may be in a range of 1 to 100 W/cm$^3$, preferably 10 to 100 W/cm$^3$, but the present invention is not limited thereto. When the carbonization is induced within this power density range, the Joule's heat may be generated by allowing the fiber to generate heat through electrical conduction to induce a radical reaction, and the crystallinity of the carbon fibers may be improved to ensure the excellent strength and electrical conductivity.

Also, according to one aspect of the present invention, because the electric current may be applied for 5 seconds to 1 minutes, preferably 5 to 40 seconds, the carbonization may be performed by realizing the higher temperature within a shorter time, compared to those in other methods.

According to one aspect of the present invention, the graphene-based fiber may further go through a stabilization step before the carbonization. The stabilization step may be performed by heating the graphene-based fiber to 280 to 320° C. in the air at 1° C. per minute and oxidatively stabilizing the graphene-based fiber for 30 to 90 minutes to manufacture infusibilized fibers. As the graphene-based fiber goes through the stabilization step, the graphene-based fiber is subjected to a dehydrogenation reaction and an oxidation reaction so that hydrogen atoms are detached in the form of molecules under an oxidative atmosphere, or an intermolecular bond is induced due to binding of oxygen. In this case, as reactive oxygen atoms are uniformly and effectively delivered into the graphene-based fiber, a stable trapezoidal structure may be formed throughout the graphene-based fiber. Therefore, the graphene-based fiber may have excellent flame resistance.

Also, the stabilization step is a liquid-phase carbonization reaction in which low-boiling-point components are volatilized through a softened molten phase, and some of the low-boiling-point components are thermally decomposed and released out of this system, and the residual components are cyclized, aromatized, and polycondensed while being activated. The liquid-crystalline aromatic compound, which is a polycyclic aromatic planar molecule intercalated between the layers of the graphene-based material in the graphene-based fiber through the stabilization step as described above, may be coagulated using the van der Waals force as a driving force, and evenly piled up on each other to further improve the orientation and liquid crystallinity and remarkably improve the mechanical strength.

The graphene-based carbon fiber according to the present invention is obtained by carbonizing the graphene-based fiber manufactured by the aforementioned method of manufacturing a graphene-based fiber.

The graphene-based carbon fiber according to the present invention may be a graphene-based carbon fiber in which the liquid-crystalline aromatic compound is intercalated into the graphene-based material, and carbonized. The graphene-based carbon fiber may be a graphene-based carbon fiber manufactured by the aforementioned manufacturing method.

Specifically, the graphene-based carbon fiber may be obtained by intercalating the liquid-crystalline aromatic compound into the graphene-based material via a π-π stacking bond. The π-π stacking bond means that polycyclic aromatic groups are evenly piled up and bonded to each other. As a specific example, the liquid-crystalline aromatic compound (e.g., a polycyclic aromatic compound) is bonded between the planes of the graphene-based materials via a strong interaction. In this case, although the strength is weak, a sufficient amount of the π-π stacking bonds are formed. Therefore, the graphene-based carbon fiber thus manufactured may express superior mechanical strength.

According to one aspect of the present invention, the graphene-based carbon fiber may be obtained by spinning a blend mixture of the liquid-crystalline aromatic compound and the graphene-based material, followed by carbonizing the blend mixture. When a spinning solution in which a conventional graphene-based material is dissolved in a solvent includes up to 1% by weight of the graphene-based material, gelation may occur, and the fluidity of the spinning solution may be restricted due to the high viscosity. Therefore, because the graphene-based carbon fiber including a low concentration of the graphene-based material is manufactured in the spinning solution, the spinning solution has limitations in improving the electrical conductivity. However, in the present invention, when the blend mixture is spun as described above to manufacture the graphene-based carbon fiber, the graphene-based carbon fiber may have superior electrical conductivity and thermal conductivity because the graphene-based carbon fiber includes a high concentration of the graphene-based material so that the graphene-based carbon fiber can be formed at a high density.

Also, according to one aspect of the present invention, the graphene-based carbon fiber may improve a degree of crystallization of carbon fibers and a degree of crystal orientation in a direction of the fiber axis, and may have excellent thermal conductivity and electrical conductivity by carbonizing a mixture in which the graphene-based material and the liquid-crystalline aromatic compound are oriented in the graphene-based carbon fiber.

The blend mixture of the present invention may include the graphene-based material and the liquid-crystalline aromatic compound at a weight ratio of 1:0.25 to 1:100, preferably a weight ratio of 1:0.5 to 1:50, and more preferably a weight ratio of 1:0.5 to 1:30. When the graphene-based material and the liquid-crystalline aromatic compound are combined as described above, the blend mixture may exhibit a liquid crystal phase having excellent orientation, and may remarkably improve the mechanical strength.

The graphene-based carbon fiber of the present invention may have an advantage of the graphene-based material and an advantage of liquid crystals at the same time. Therefore, the directionality of the graphene-based carbon fiber may be adjusted using an external field such as a magnetic field, a flow field, or the like, which is one of the intrinsic characteristics of the liquid crystals, and the graphene-based fiber may exhibit anisotropically optical, dielectric, mechanical properties, and the like in macroscopic aspects, thereby making it possible to enlarge the utilization of graphene-based materials and establish new processes.

Hereinafter, the graphene-based fiber, the graphene-based carbon fiber, and the method of manufacturing the same according to the present invention will be described in further detail with reference to the following examples thereof. However, it should be understood that the following examples are illustrative only to describe the present invention in detail, but are not intended to limit the scope of the present invention, and thus may be embodied in various forms.

Unless otherwise defined, all the technical and scientific terms also have the same meaning as commonly understood by one of ordinary skill in the art to which the present invention belongs. The terminology used herein for description is intended to effectively describe particular embodiments only and is not intended to be limiting of the present invention.

Also, the units of the additives not specifically described in this specification may be % by weight.

Preparation Example 1

A first composition in which 2% by weight of fluidized catalytic cracking-decant oil (FCC-DO; having an average molecular weight of 300 Da and a degree of orientation of 0.673, as determined by MALDI-TOF) was dissolved in tetrahydrofuran was prepared. A second composition in which 2% by weight of graphene oxide (Standard Graphene Co., manufactured by a Hummer's method, and oxidized to have a carbon:oxygen atomic ratio of 1:0.6) was dissolved in tetrahydrofuran was prepared. Each of the first composition and the second composition was used to form a mixture, and the mixture was centrifuged. Then, the tetrahydrofuran was completely removed using a vacuum pump to prepare a blend mixture.

Preparation Example 2

A first composition in which 2% by weight of fluidized catalytic cracking-decant oil (FCC-DO; having an average molecular weight of 300 Da and a degree of orientation of 0.673, as determined by MALDI-TOF) was dissolved in tetrahydrofuran was prepared. A second composition in which 0.01% by weight of reduced graphene oxide (Standard Graphene Co., manufactured by a Hummer's method, and oxidized to have a carbon:oxygen atomic ratio of 1:0.05) was dissolved in tetrahydrofuran was prepared. Each of the first composition and the second composition was used to form a mixture, and the mixture was centrifuged. Then, the tetrahydrofuran was completely removed using a vacuum pump to prepare a blend mixture.

Preparation Example 3

This experiment was performed in the same manner as in Preparation Example 1, except that a first composition in which 2% by weight of coal tar was dissolved in tetrahydrofuran was used instead of the first composition in which 2% by weight of fluidized catalytic cracking-decant oil (FCC-DO) was dissolved in tetrahydrofuran.

Preparation Example 4

This experiment was performed in the same manner as in Preparation Example 1, except that a first composition in which 4% by weight of the fluidized catalytic cracking-decant oil (FCC-DO) was dissolved in tetrahydrofuran was used.

Preparation Example 5

This experiment was performed in the same manner as in Preparation Example 1, except that 0.5% by weight of the fluidized catalytic cracking-decant oil (FCC-DO) was dissolved in tetrahydrofuran was used.

Preparation Example 6

This experiment was performed in the same manner as in Preparation Example 1, except that a second composition in which 3% by weight of graphene oxide (Standard Graphene Co., manufactured by a Hummer's method) was dissolved in tetrahydrofuran was used.

Preparation Example 7

This experiment was performed in the same manner as in Preparation Example 1, except that the fluidized catalytic cracking-decant oil (FCC-DO) was used at an FCC-DO:coal tar weight ratio of 50:50.

Preparation Example 8

This experiment was performed in the same manner as in Preparation Example 1, except that graphene oxide which was oxidized to have a carbon:oxygen atomic ratio of 1:1 was used.

Preparation Example 9

This experiment was performed in the same manner as in Preparation Example 1, except that FCC-DO, which had an average molecular weight of 500 Da and a degree of orientation of 0.701, as determined by MALDI-TOF, was used.

Preparation Example 10

This experiment was performed in the same manner as in Preparation Example 1, except that MALDI-TOF, which had an average molecular weight of 800 Da and a degree of orientation of 0.510, as determined by FCC-DO, was used.

Preparation Example 11

This experiment was performed in the same manner as in Preparation Example 1, except that a second composition including 5% by weight of graphene oxide was used.

Preparation Example 12

This experiment was performed in the same manner as in Preparation Example 1, except that mesophase pitch was used instead of the fluidized catalytic cracking-decant oil (FCC-DO).

Comparative Preparation Example 1

This experiment was performed in the same manner as in Preparation Example 1, except that only the second composition was used as the spinning solution without using the first composition including the liquid-crystalline aromatic compound. However, because the graphene oxide in the second composition was not melted, the second composition was unable to be melt-spun into fibers. Also, when the fibers were manufactured through the wet spinning or electrospinning, the graphene-based material was not dissolved in the solvent, and the gelation occurred, thereby making it impossible to perform the spinning.

Example 1

1. Melting Step

A cylinder of a spinning machine was filled with the blend mixture prepared in Preparation Example 1, and the blend mixture was then heated. In this case, the blend mixture was heated to 350° C., and then kept for 30 minutes to secure the thermal stability. Thereafter, the blend mixture was maintained at 300° C. for an hour to melt the blend mixture.

2. Spinning Step

A spinning temperature of the blend mixture was lowered to 300° C., and the blend mixture was spun at a nitrogen pressure of 0.5 bars to obtain a spun fiber. In this case, a diameter of a spinneret hole used herein was 0.5×0.5 mm, and the spun fiber was taken up at a take-up velocity of 300 m/min.

Example 2

This experiment was performed in the same manner as in Example 1, except that the blend mixture prepared as described in Preparation Example 2 was used.

Example 3

This experiment was performed in the same manner as in Example 1, except that the blend mixture prepared as described in Preparation Example 3 was used.

Example 4

This experiment was performed in the same manner as in Example 1, except that the blend mixture prepared as described in Preparation Example 4 was used.

Example 5

This experiment was performed in the same manner as in Example 1, except that the blend mixture prepared as described in Preparation Example 5 was used.

Example 6

This experiment was performed in the same manner as in Example 1, except that the blend mixture prepared as described in Preparation Example 6 was used.

Example 7

This experiment was performed in the same manner as in Example 1, except that the blend mixture prepared as described in Preparation Example 7 was used.

Example 8

This experiment was performed in the same manner as in Example 1, except that the blend mixture prepared as described in Preparation Example 8 was used.

Example 9

This experiment was performed in the same manner as in Example 1, except that the blend mixture prepared as described in Preparation Example 9 was used.

Example 10

This experiment was performed in the same manner as in Example 1, except that the blend mixture prepared as described in Preparation Example 10 was used.

Example 11

This experiment was performed in the same manner as in Example 1, except that blend mixture prepared as described in Preparation Example 11 was used.

Example 12

This experiment was performed in the same manner as in Example 1, except that the blend mixture prepared as described in Preparation Example 12 was used.

Example 13

The blend mixture prepared in Preparation Example 1 was wet-spun at 25° C. using a spinning nozzle having a spinning nozzle diameter of 250 μm. The blend mixture was spun at a jetting velocity of 0.1 m/min into a coagulant solution (i.e., a mixed solution of calcium chloride ($CaCl_2$)) with an aqueous solution in which water and ethanol were mixed at 25° C. at a weight ratio of 3:1), and then taken up at 0.1 m/min. The taken-up filaments were washed with water to remove the residual calcium chloride, dried, and then thermally elongated 1.3-folds while adjusting the temperature to 70° C. using an infrared lamp.

Example 14

The blend mixture prepared in Preparation Example 1 was fed to a spinning solution-feeding device connected to a nozzle. The blend mixture was fed at a feeding velocity of 4 mL/hr, and the nozzle having an inner diameter of 0.5 mm was used. Furthermore, the electrospinning was performed under spinning conditions of an applied voltage of 25 kV, a spinning distance of 18 cm between a spinning nozzle and a current collector, a temperature of 30° C., and a relative humidity of 60%.

1. Spinning Properties

The spinning properties were evaluated using the criteria for judgement.

o: There is no troubles such as fiber cutting, and the fibers are possibly taken up.

Δ: Fibers are often cut, but are possibly taken up at a specified take-up velocity.

X: Fibers are not taken up at a specified take-up velocity.

[Experimental Example 1] Confirmation of Orientation of Blend Mixture

Figure 2:
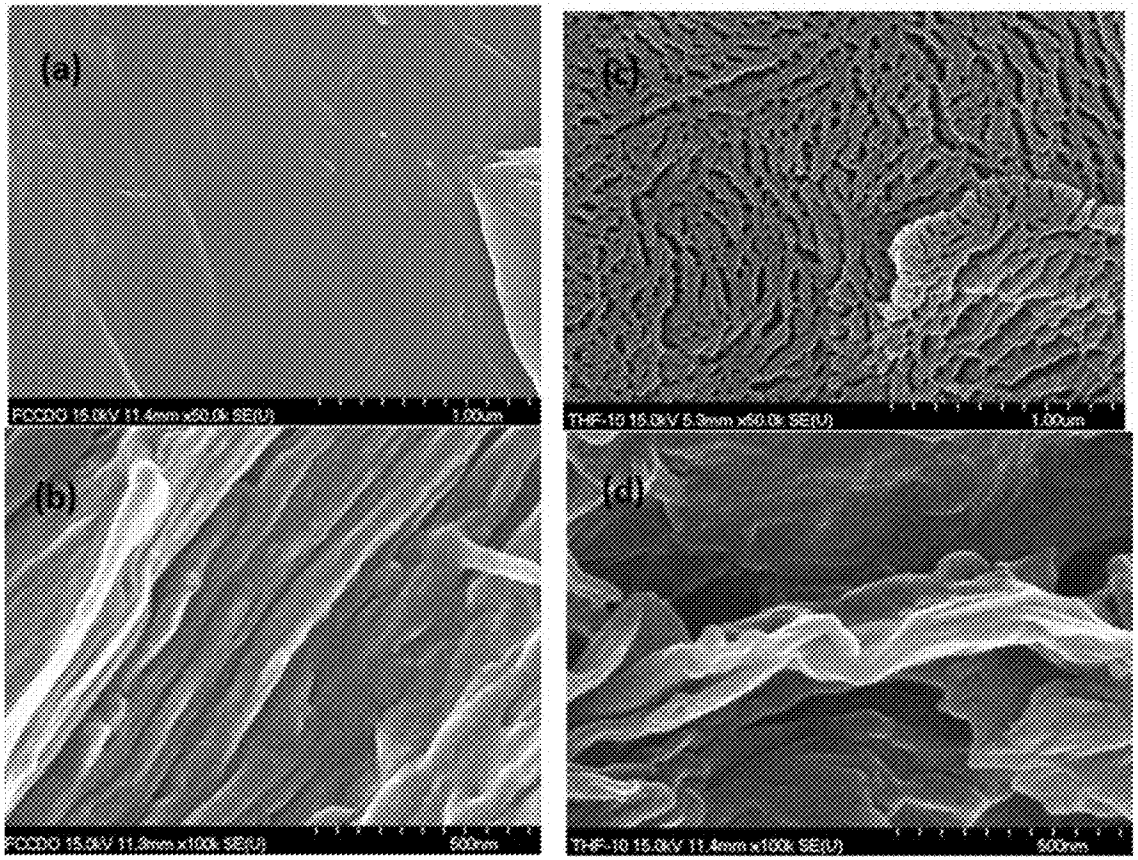
FIG. 2 shows images of (a) a surface and (b) a cross section of a blend mixture according to one embodiment of the present invention, as observed under a scanning electron microscope, and shows images of (c) a surface and (d) a cross section of the blend mixture after a liquid-crystalline aromatic compound is removed by etching the blend mixture with tetrahydrofuran.

As shown in FIG. 2, it was confirmed that, when the surface (a) and the cross section (b) of the blend mixture of Preparation Example 1 were observed by a scanning electron microscope, the liquid-crystalline aromatic compound was uniformly dispersed between the layers of graphene oxide in the graphene-based fiber manufactured in Example 1 of the present invention. To clearly determine whether the liquid-crystalline aromatic compound was intercalated between the layers of graphene oxide as described above, the blend mixture was etched with tetrahydrofuran to remove the liquid-crystalline aromatic compound from the blend mixture, and the surface (c) and the cross section (d) of the blend mixture were observed by a scanning electron microscope. Based on the fact that the liquid-crystalline aromatic compound was removed and the backbone of graphene oxide was exposed by etching blend mixture, it can be seen that the liquid-crystalline aromatic compound was present in a state in which the liquid-crystalline aromatic compound was intercalated between the layers of graphene oxide. As a result, it can be seen that the blend mixture of the present invention had a structure in which the liquid-crystalline aromatic compound was uniformly present between the layers of graphene oxide, and had an oriented structure.

It can be seen that the graphene-based fibers manufactured in Examples 1 to 14 had excellent orientation and crystallinity.

Also, in the graphene-based fibers manufactured in Examples 1 to 12 of the present invention, a content of the graphene-based material was able to be further increased by spinning and melt-spinning the graphene-based material having no melting characteristics as the liquid-crystalline aromatic compound was intercalated into the layers of the graphene-based material via a π-π stacking bond. Also, as the spinning speed increased through the melt-spinning and the graphene oxide was included at a high density, the yield and crystallinity were able to be further improved.

Also, it was confirmed that the liquid-crystalline aromatic compound of the present invention had superior crystallinity when the liquid-crystalline aromatic compound had a degree of orientation of 0.6 to 0.9 and an average molecular weight of 100 to 2,000 Da, as determined by MALDI-TOF.

In addition, it was confirmed that the graphene oxide of the present invention had superior crystallinity when the graphene oxide was oxidized so that the graphene oxide had a carbon:oxygen atomic ratio of 1:0.05 to 1:0.6.

The graphene-based fibers manufactured in Examples 1 to 14 were subjected to oxidative stabilization and carbonization steps, as will be described below, to prepare the graphene-based carbon fibers, and the physical properties of the graphene-based carbon fibers were checked.

3. Oxidative Stabilization Step

The graphene-based fiber obtained through the spinning was heated at 1° C. per minute while circulating the air using a hot-air circulation channel, and maintained at 300° C. for an hour to oxidatively stabilize the graphene-based fiber.

4. Carbonization Step

The stabilized fiber which had gone through the stabilization step was heated to 1,000° C. at a 5° C./min under a nitrogen atmosphere, and then maintained for an hour to manufacture the graphene-based carbon fiber.

Example 15

This experiment was performed in the same manner as in Example 1, except that, after the graphene-based fiber manufactured in Example 1 was subjected to the stabilization step, the graphene-based fiber was carbonized in three steps by heating the graphene-based fiber using the carbonization step including the primary carbonization at 800° C., the secondary carbonization at 1,200° C., and the tertiary carbonization at 2,000° C., respectively, with a heating rate of 5° C./min, and maintaining the graphene-based fiber for an hour.

Example 16

This experiment was performed in the same manner as in Example 1, except that, after the graphene-based fiber manufactured in Example 1 was subjected to the stabilization step, the graphene-based fiber was primarily carbonized at 800° C. for an hour as the carbonization step, and both ends of the primarily carbonized fiber was allowed to come into contact onto an electrical conduction terminal under a nitrogen atmosphere so that the primarily carbonized fiber was carbonized for 2 minutes at an electric power density of 50 W/cm$^3$ in which the fiber was heated to a temperature of 2,000° C.

Experimental Example 2

2. Measurement of Electrical Conductivity of Graphene-Based Carbon Fiber

The electrical conductivity of each of the graphene-based carbon fibers of Examples was measured using a 4-point probe measurement method by disposing electrodes so that a gap between the electrodes was set to 1 cm using CMT-SR1000N (AIT Co., Ltd.), allowing a sample to come into contact with the electrodes, and connecting the electrodes to a measuring machine capable of measuring an electric current and a voltage.

3. Tensile Strength

A measuring specimen was prepared according to the ASTM D 638 (Standard Test Method for Tensile Properties of Plastics), and a tensile strength of the measuring specimen was measured using UTM 5982. (Tensile strength [Pa] =Maximum load [N]/Cross-sectional area of initial sample [m$^2$])

4. Raman Analysis (Degree of Crystallization)

A carbon fiber has absorption regions at 1,350 to 1,380 cm$^{-1}$ (D peak) and 1,580 to 1,600 cm$^{-1}$ (G peak), and a degree of crystallization of the carbon fiber may be determined depending on the intensities and widths of the two regions. The D peak is associated with an amorphous state of a carbon structure of carbon atoms, and the G peak (graphite peak) represents a graphite crystal structure in the sp$^2$ hybrid orbital bonding. Relative improvement of the degree of crystallization was determined through the intensity value (ID/IG) for the peak of each of the regions.

It can be seen that the graphene-based carbon fibers manufactured in Examples 1 to 16 had excellent electrical conductivity, tensile strength, and crystallinity. Further, it can be seen that the carbon fibers manufactured through the melt-spinning in Examples 1 to 12 and Examples 14 to 16 had superior electrical conductivity, tensile strength, and crystallinity.

Also, in the graphene-based carbon fibers manufactured in Examples 1 to 12 and Examples 14 to 16 of the present invention, the content of the graphene-based material was able to be increased by melting and melt-spinning the graphene-based material having no melting characteristics as the liquid-crystalline aromatic compound was intercalated between the layers of the graphene-based material via a π-π stacking bond. Also, the graphene-based carbon fibers were able to include a high density of the graphene-based material, have excellent mechanical strength, and also have further improved yield and crystallinity due to an increase in spinning speed through the melt-spinning.

Also, it was confirmed that the liquid-crystalline aromatic compound of the present invention had superior electrical conductivity, thermal conductivity, and crystallinity when the liquid-crystalline aromatic compound had a degree of orientation of 0.6 to 0.9 and an average molecular weight of 100 to 2,000 Da, as determined by MALDI-TOF.

Further, it was confirmed that the graphene oxide of the present invention had superior electrical conductivity, thermal conductivity, and crystallinity when the graphene oxide was oxidized so that the graphene oxide had a carbon: oxygen atomic ratio of 1:0.05 to 1:0.6.

The graphene-based fiber and the graphene-based carbon fiber according to the present invention include the liquid-crystalline aromatic compound and the graphene-based material, and thus have an advantage in that the graphene-based fiber and the graphene-based carbon fiber exhibit a liquid crystal phase and have high crystallinity and orientation by spinning the blend mixture in which the liquid-crystalline aromatic compound is intercalated into the graphene-based material.

Also, the graphene-based fiber and the graphene-based carbon fiber according to the present invention have an advantage in that, because the liquid-crystalline aromatic compound is intercalated into the graphene-based material via a π-π stacking bond, it is possible to spin the blend mixture as the blend mixture includes a high concentration of the graphene-based material, and the yield and crystallinity are improved due to an increase in spinning speed.

Additionally, the graphene-based fiber and the graphene-based carbon fiber according to the present invention have an advantage in that the degree of crystallization of the liquid-crystalline aromatic compound and the degree of crystal orientation in a direction of the fiber axis are remarkably improved.

Further, the graphene-based fiber and the graphene-based carbon fiber according to the present invention have an advantage in that the graphene-based fiber and the graphene-based carbon fiber have excellent electrical conductivity and tensile strength, and have an orientation toward a liquid crystal phase.

Although the graphene-based fiber, the graphene-based carbon fiber, and the method of manufacturing the same have been described in the present invention with reference to certain subject matters and limited examples thereof, it should be understood that the subject matters and limited examples described herein are provided to aid in understanding the present invention more comprehensively, but are not intended to limit the present invention. Therefore, it will be apparent to those skilled in the art to which the present invention belongs that various modifications can be made without departing from the scope of the present invention.

Thus, the scope of the present invention is not intended to be limited to the examples described herein, and thus all types of the appended claims, and equivalents or equivalent modifications thereof come within the scope of the present invention.

The invention claimed is:

1. A method of manufacturing a graphene-based fiber, the method comprising:

a) mixing a first composition comprising a liquid-crystalline aromatic compound having an average molecular weight of 100 to 2,000 Da and a solvent, and a second composition comprising a graphene-based material and a solvent to prepare a blend mixture;

b) removing the solvent in the blend mixture;

c) melting the blend mixture by heating; and d) spinning the blend mixture to obtain a graphene-based fiber, wherein the blend mixture comprises the graphene-based material and the liquid-crystalline aromatic compound at a weight ratio of 1:0.5 to 1:30, and 30 to 60% by weight of the graphene based-material, based on the total weight of the solid content of the blend mixture, wherein the blend mixture is melt-spun to obtain the fiber.

2. The method of claim 1, wherein the first composition comprises 0.01 to 80% by weight of the liquid-crystalline aromatic compound, based on the total weight of the first composition.

3. The method of claim 1, wherein the liquid-crystalline aromatic compound is any one or a mixture of two or more selected from fluidized catalytic cracking-decant oil (FCC-DO), coal tar, and mesophase pitch.

4. A method of manufacturing a graphene-based carbon fiber, the method further comprising carbonizing the graphene-based fiber manufactured by the method of claim 1.

5. The method of claim 4, wherein the carbonization is performed at 800 to 3,000° C. under an inert gas atmosphere.

6. A graphene-based fiber in which a liquid-crystalline aromatic compound having an average molecular weight of 100 to 2,000 Da is intercalated into a graphene-based material, wherein the graphene-based material and the liquid-crystalline aromatic compound are coupled at a weight ratio of 1:0.5 to 1:30, wherein the fiber is obtained by melt-spinning a blend mixture of the liquid-crystalline aromatic compound and the graphene-based material without a solvent, and wherein the blend mixture comprises 30 to 60% by weight of the graphene-based material, based on the total weight of the solid content of the blend mixture.

7. The graphene-based fiber of claim 6, wherein the fiber is in the form of layers in which the graphene-based material is oriented in a parallel direction with respect to the fiber axis, and the liquid-crystalline aromatic compound is positioned between the layers so that the liquid-crystalline aromatic compound is oriented in the parallel direction.

8. The graphene-based fiber of claim 6, wherein the liquid-crystalline aromatic compound and the graphene-based material are intercalated via a π-π stacking bond.

* * * * *